US006126034A

United States Patent [19]

Borden et al.

[11] Patent Number: 6,126,034

[45] Date of Patent: Oct. 3, 2000

[54] LIGHTWEIGHT METAL BEVERAGE CONTAINER

[75] Inventors: Craig L. Borden, Leland; McKay C. Brown; Edmund T. Gillest, both of Aurora, all of Ill.; David P. Lieb, Hendersonville, Tenn.

[73] Assignee: Alcan Aluminum Corporation, Cleveland, Ohio

[21] Appl. No.: 09/251,504

[22] Filed: Feb. 17, 1999

Related U.S. Application Data

[60] Provisional application No. 60/074,826, Feb. 17, 1998.

[51] Int. Cl.[7] ..... B65D 8/12

[52] U.S. Cl. ..... 220/671; 206/509; 220/670

[58] Field of Search ..... 220/619, 906, 220/674, 671, 670, 669, 620, 615, 610; 206/208, 509

[56] References Cited

U.S. PATENT DOCUMENTS

| | | | |
|---|---|---|---|
| 941,720 | 11/1909 | Meier | 220/669 |
| 2,152,245 | 3/1939 | Davies | 220/671 |
| 3,168,777 | 2/1965 | DeRidder et al. | 220/669 |
| 3,265,310 | 8/1966 | Cohen | 220/669 |
| 4,111,328 | 9/1978 | Eggert et al. | 220/4.01 |
| 4,685,582 | 8/1987 | Pulciani et al. | 220/606 |
| 4,723,681 | 2/1988 | Glerum | 220/671 |
| 5,261,558 | 11/1993 | Claydon | 220/671 |
| 5,279,442 | 1/1994 | Jentzsch et al. | 220/671 |
| 5,339,975 | 8/1994 | Stoner | 220/4.27 |
| 5,595,322 | 1/1997 | Kramer | 220/619 |

*Primary Examiner*—Stephen Castellano
*Attorney, Agent, or Firm*—Calfee, Halter & Griswold LLP

[57] ABSTRACT

Lightweight beverage containers disclosed herein require less metal per container, exhibit less earing and have one or more of the following features: 1) a reduced seam between the can end and the can body, 2) a side wall having vertically disposed alternating portions of relatively thicker and relatively thinner metal, 3) a can end dimensioned to fit within the domed bottom of a vertically adjacent similar can when stacked, 4) a can body produced from an acircular blank dimensioned to produce said can body without ears, and 5) a can body produced from a cup having a variable radius between the side of said cup and the bottom thereof.

15 Claims, 4 Drawing Sheets

LIGHTWEIGHT METAL BEVERAGE CONTAINER

RELATED APPLICATION

This application claims the benefit of our earlier U.S. Provisional patent application Ser. No. 60/074,826, filed Feb. 17, 1998, for Lightweight Metal Beverage Container, the entire disclosure of which is incorporated herein by reference.

FIELD OF THE INVENTION

This invention generally relates to two piece metal beverage containers and closures therefore. More specifically, the invention relates to beverage containers that can be made using less metal per container or lightweight containers.

BACKGROUND OF THE INVENTION

The present invention relates generally to drawn and ironed two-piece containers having an end seamed to the open end of the container body. One common use for such containers is as a beverage package. More particularly the present invention relates to light weight containers which require less metal per container and can have a lower cost to produce and higher overall quality when compared to currently produced versions. The lightweight beverage containers of the present invention have one or more of the following features: 1) a reduced seam between the can end and the can body, 2) a side wall having vertically disposed alternating portions of relatively thicker and relatively thinner metal, 3) a can end dimensioned to fit when stacked within the domed bottom of a vertically adjacent similar can, 4) a can body produced from a non-circular blank dimensioned to produce said can body with reduced ears, and 5) a can body produced from a cup having a variable radius between the side of said cup and the bottom thereof.

A typical two piece container consists of a unitary deep drawn body that includes a cylindrical side wall and an integral bottom wall closing one end of the can. Usually the beverage can body has a necked inward throat at its top which terminates in an outwardly extending body curl. An end for the can is provided with an end curl that can interact with the body curl in seaming apparatus to attach the end to the can body after filing of the can to provide the requisite hermetic seal.

It is economically very desirable to form the can bodies and ends from as thin a sheet stock as possible while retaining the necessary performance parameters. Numerous container constructions have been developed in the past. Many of these have been directed toward improving the performance of the beverage container and as a result have allowed a reduction in the metal usage per container. Indeed the average number of 12 ounce beverage containers produced from one pound of metal has increased substantially over the past several years.

A number of methods are known for fabricating the can bodies. In one method, known as the "draw and iron" method, a blank is formed from the stock material. The blank is then formed into a large diameter cup in a ram press. The large diameter cup is then reformed into a cup having essentially the diameter desired for the final can body. The cup is then supported from its interior and one or more ironing rings having inside diameters equal to the desired diameter of the finished can body are passed over the outside of the side wall of the can body. This thins and stretches the metal of the side wall making the can body taller.

Optionally, beverage can bodies are then subjected to an additional forming step to modify the cylindrical shape of the side wall of the can body to create a desirable appearance. Generally this is accomplished by inserting a die or inflatable bladder into the can body and using it to press the side wall of the can body outward into a mating die to form the desired pattern or shape. An exemplary process is described in U.S. Pat. No. 5,533,373. These processes involve extra processing steps, which increase the cost of the cans produced, and are predominately used for aesthetic reasons.

After cupping, drawing and again after ironing the top edge of the can body is uneven because the metal tends to stretch slightly more in the direction of the grain of the metal than across the grain of the metal. This condition is called "earing". A can body exhibiting earing must be trimmed along its top edge to facilitate seaming of the can body to the can end. Earing can be reduced by forming the can body from a non-circular blank as described in U.S. Pat. No. 4,711,611. However, the improved non-circular blanks of the present invention are capable of reducing earing in the cupper even more that those described in the prior art.

The trimmed can body is then seamed to a can end to form a hermetically sealed package for a beverage or other food product. Conventional beverage can ends have a relatively flat central panel with an easy open pull-tab attached thereto. The central panel has a countersunk ridge around the periphery of the central panel and a seaming curl projecting upwardly and outwardly from the countersunk ridge. During seaming the seaming curl is folded together with the top edge of the can body to form a complete hermetic seal between the can body and the can end. Some attempts have been made to reduce the size of the seam with a corresponding reduction in the amount of metal consumed by the container. For example a conventional seam used in an aluminum beverage can has a height of about 0.100 inches and the "microseam" described in U.S. Pat. No. 5,595,322 with respect to steel food cans is only 0.060 inches tall. However, steel food cans have flat ends and typically do not have pull-tabs. Accordingly, steel food can ends are readily stackable prior to seaming to a food can body. On the other hand, any attempt to use a "microseam" from a food can or other reduced height seam in a beverage can end will result in a can end that will not form a stable stack prior to seaming. Accordingly, handling by high speed seaming equipment is impeded and there is a need for a stackable design.

SUMMARY OF THE INVENTION

The present invention relates to drawn and ironed two-piece containers having an end seamed to the open end of the container body to form a beverage package. More particularly the present invention relates to lightweight containers that require less metal per container to produce. The lightweight beverage containers of the present invention have one or more of the following features: 1) a reduced seam between the can end and the can body, 2) a side wall having vertically disposed alternating portions of relatively thicker and relatively thinner metal, 3) a can end dimensioned to fit within the domed bottom of a vertically adjacent similar can when stacked, 4) a can body produced from an acircular blank dimensioned to produce said can body without ears, and 5) a can body produced from a cup having a variable radius between the side of said cup and the bottom thereof.

Containers produced according to this invention should require less metal per container and yet provide performance equal to existing containers. The metal used in the containers of the present invention can be either aluminum or steel or combinations thereof. For example the container can have an aluminum end and body, a steel end and body or an aluminum end and a steel body.

One or more of the present features can be combined in a single beverage package. In fact, any number or combination of the features described above can be combined in a single beverage package of the present invention.

DETAILED DESCRIPTION

Figure 1:
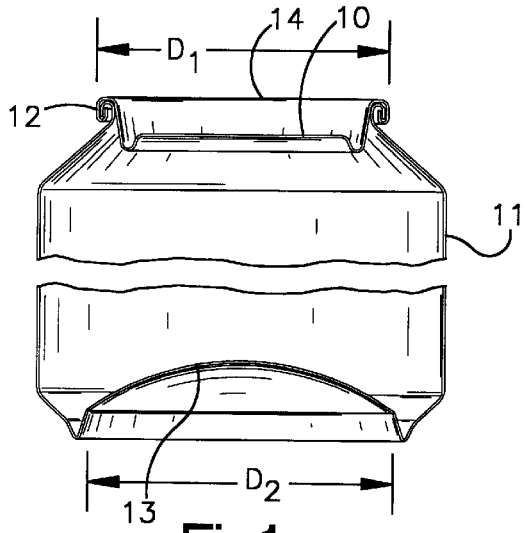
FIG. 1 is a vertical cross section of a lightweight can made in accordance with the present invention.

FIG. 1 illustrates a cross section of a lightweight can formed from a can end 10 and a can body 11 seamed together by a folded seam 12. The can bottom has a dome 13 which has a larger diameter D2 when compared to the diameter D1 of the seamed can end so that the can end will fit within the dome of an adjacent identical can when stacked one on top of the other. This will allow further reductions in the size of the can end than permitted by current designs where the bottom of the can fits inside the top of the adjacent can when stacked. A corresponding weight reduction will occur with the reduction in size of the can end.

The can end 10 is made of aluminum or steel, and preferably is made of an aluminum alloy such as a 5000 series aluminum alloy such as AA5082 or AA5182. Other aluminum alloys such as 3000 series aluminum alloys can also be used provided the strength; formability and other properties of the alloy are adequate for the application. Preferably the can end is coated with an appropriate coating on both sides and has an easy open pull-tab attached to the top side thereof. Generally the pull-tab does not protrude above the top rim 14 of the can and in no event can it interfere with the ability of the can to stack with similar cans.

The can body of a two piece drawn and ironed beverage can is conventionally made from a circular blank of metal stamped from a coil of sheet metal. In a high speed production line for manufacturing can bodies, a coil of metal sheet having a width equal to up to 12 to 14 times the diameter of the desired circular blank is used. The circular blanks are punched from the coil in the cupper. In the cupper a relatively short, relatively large diameter cup is first formed, then reformed into a relatively taller relatively smaller diameter cup. The reformed cup is then ironed to increase the height of the side wall on the cup. However, the top rim of a cup formed in this manner is not level. The rim has an undulating edge with four (or more) high and four (or more) low spots that are created by the different rates of stretch of the metal in the direction of rolling of the coil and across the width of the coil. These high spots must be trimmed off before the can body can be seamed to a can end. This phenomenon is called earing. Earing causes scrap and therefore increases the amount of metal required to make each can body.

Figure 3:
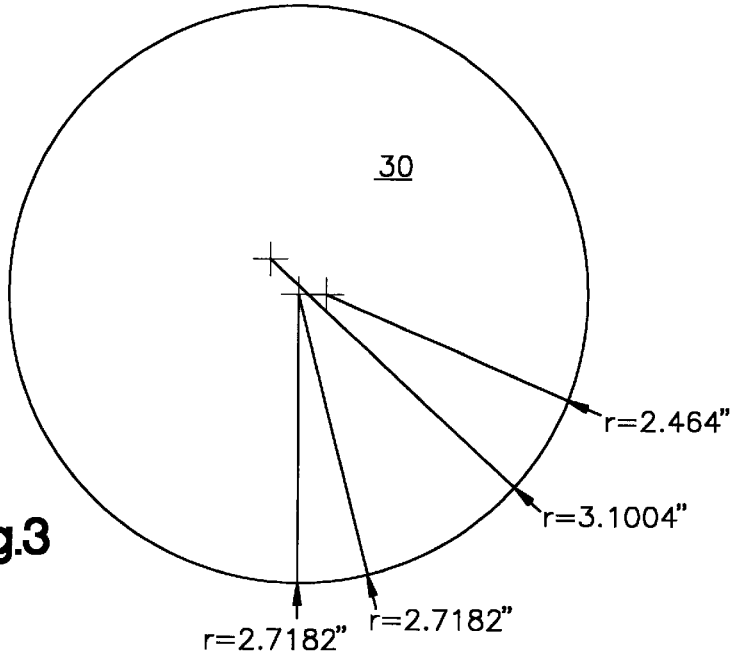
FIG. 3 is a top view of a non-circular blank useful in the present invention.

Several attempts have been made to produce can body sheet that will reduce or eliminate earing, however, earing remains a problem. According to the present invention earing can be reduced but probably not totally eliminated by precisely contouring the shape of the blank 30 from which the can body is produced. The blank thus produced is acircular and for an aluminum can body alloy such as AA 3004 has a profile substantially as shown in FIG. 3. Other alloys and other tempers will require different profiles, however, the principles for determining the profile are the same.

The non-circular blank 30 of the present invention is specifically designed to accommodate the earing that occurs both in the cupping step and in the ironing step of the process. Specifically, it has now been found that counteracting earing tendencies exist between the cupping stage and the ironing stage of the process. During the formation of the cup, the metal stretches slightly more in the direction of the grain (the direction of rolling) than it does across the grain (across the width of the coil of sheet metal). This produces "ears" at the areas associated with the end grain of the metal. In addition the metal stretches relatively more at 45° to the direction of the grain than at other locations. This produces four additional "ears" at these locations. However, along with producing ears during cupping there is a slight thinning of the metal in the side wall of the cup in the locations where the "ears" formed. Accordingly, during ironing these thinner areas are ironed less and tend to counteract the earring produced during cupping and the thicker areas are ironed more producing additional ears. The impact of this complex behavior can be substantially reduced by the techniques of the present invention. However, it is probably not possible to completely eliminate the affect of earring due to minor variations in the metal of specific blanks.

Because earing occurs in predictable locations relative to the direction of the grain of the metal, it is therefore possible to calculate from the volume of trim and the location of the high and low spots around the top edge of an ironed can body the volume and location of metal that must be removed from the starting blank necessary to compensate for the cupping earing and the ironing earing. The dimensions shown on FIG. 3 show the currently preferred profile for one quadrant of a non-circular blank produced in accordance with the present invention. The portions of the blank having a larger radius correspond to portions where ears tend to form and the portions having a smaller radius are areas where ears do not tend to form. These dimensions are repeated in each of the other three quadrants of the blank.

Figure 4A:
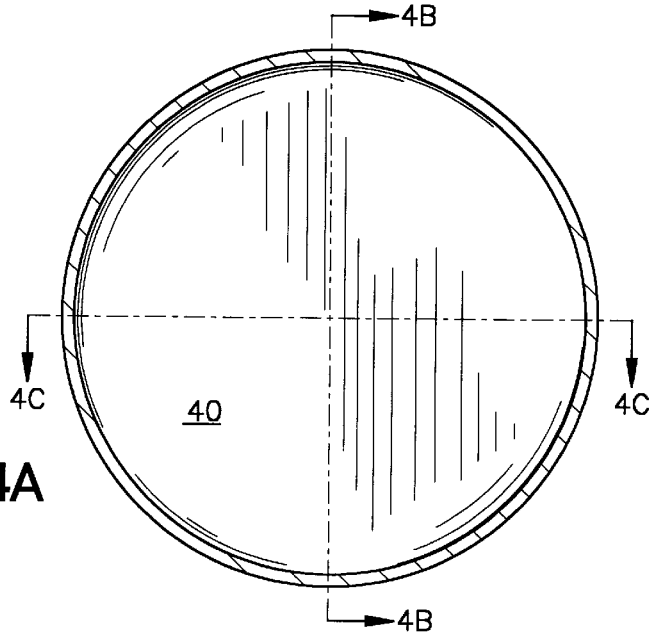
FIG. 4A is a top view of a drawn cup formed during the first stage of forming a container body according to the present invention.
Figure 4B:
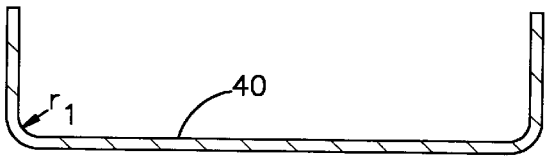
FIG. 4B is a cross section of the cup shown in FIG. 4A along the line BB.
Figure 4C:
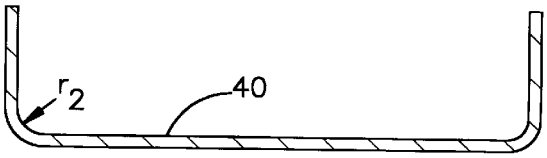
FIG. 4C is a cross section of the cup shown in FIG. 4A along line CC.

During cupping another condition known as "ovality" is also encountered. Its origin is closely related to the origin of earing. The metal not only stretches more in the direction of the grain; it also has a lower strength in the direction of the grain than it does across the grain. This differential strength causes the side wall of the initial cup formed during the draw and iron process to tend to spring back slightly more in the direction across the grain than in the direction of the grain causing the top edge of the cup to assume a slightly oval shape. While this ovality may be very slight, and even not visible to the naked eye, it is sufficient to occasionally interfere with the high-speed production of cans. To compensate for this inherent characteristic of the metal, a unique cup design and cupping die have been developed. The unique cup and die have variable radii around their bottom perimeters between the portion that forms the bottom of the can body and the portion that forms the side wall. This variable radius is slightly larger in the locations that correspond to the direction of the grain and is slightly smaller in locations that are across the grain. Commencing at a point on the side of a formed cup corresponding to the direction of the grain and assigning 0° to that point and moving 360° around the perimeter of the cup, the radius is largest at 0° and 180° and smallest at 90° and 270° and varies between these locations. The radius may vary continuously or be in segments. The individual segments may have a variable radius or a constant radius provided that overall variation described above is achieved. Combination of variable and constant radii segments may also be used. For example alternating variable radii and fixed radii segments can be advantageous. In the exemplary cup 40 shown in FIGS. 4A, 4B and 4C the radius $r_1$ is about 0.090 inches and the radius $r_2$ is about 0.110 inches.

In a conventionally formed cup, the radius is uniform around the entire bottom of the cup (or die) and is typically about 0.050 inches to about 0.150 inches. If the radius is varied according to the present invention a difference of about 0.010 inches to about 0.040 inches will exist between the radius at 0° and the radius at 90° around the perimeter of the bottom of the cup. Preferably a difference of about 0.010 inches and about 0.030 inches will exist. Generally, the more the yield strength of the metal varies from the direction of the grain to across the grain the greater the difference in the radii will be. During subsequent forming operations, after the variable radii have served their purpose, the variable radii can be reformed into a uniform profile in the final can.

Figure 2A:
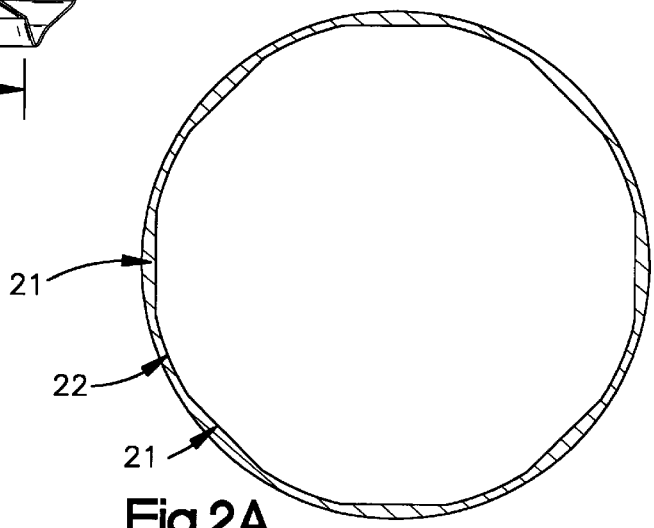
FIG. 2A is a horizontal cross section through the side wall of a can having alternating relatively thicker and relatively thinner portions according to an embodiment of the present invention.
Figure 2B:
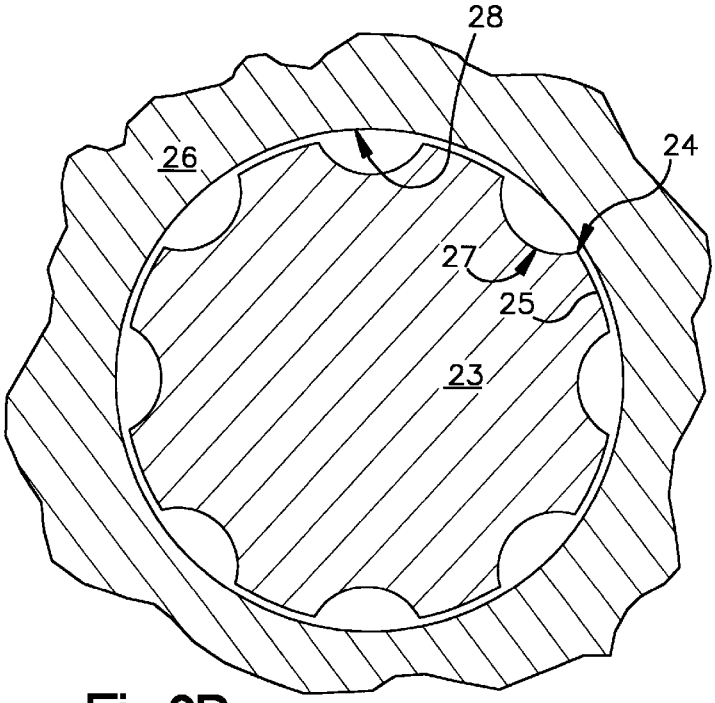
FIG. 2B is a horizontal cross section through a punch and ironing die adapted for use in forming the can side wall illustrated in FIG. 2A.

According to a further embodiment illustrated in FIGS. 2A and 2B, the light weight can of the present invention may also have a side wall with a cross section having alternating relatively thicker portions 21 and relatively thinner portions 22. The side wall can have any number of such alternating portions. Typically there will be 4 to 40 thicker portions and a like number of thinner portions and preferably from 8 to 20. The alternating portions are formed during the ironing stage during which the side wall of the can is increased in height. During conventional ironing a round mandrel is inserted into the can body and a mating round die having a diameter slightly larger than the diameter of the mandrel is drawn and ironed over the outside of the side wall of the can body. This causes the side wall of the can body to become thinner and longer. However, in accordance with the present invention a round die is used in conjunction with a mandrel having portions that conform to the inner surface of the die and portions that do not. The portions of the mandrel that do not conform to the inner surface of the ironing die can be merely flat portions. However, they may also be concave, convex or have another profile that creates a cavity between the die and the mandrel for forming the relatively thicker portion. A cross section of a mandrel 23 according to one embodiment of the present invention is shown in FIG. 2B. Preferably the transition 24 between the portions 25 of the mandrel that conform to the profile of the inner surface of the ironing die 26 and the portions 27 that do not is an arc having a radius that is smaller than the radius of the inside surface 28 of the ironing die 26.

During ironing with the die and mandrel described above, metal tends to flow from the portions where the profile of the surfaces of the die and mandrel conform to the portions where the profiles do not conform. It is this metal flow that produces the relatively thicker portions 21 and relatively thinner portions 22 in the side wall illustrated in FIG. 2A. The difference in thickness may be very slight on the order of about 0.001 inches and still be adequate for purposes of the present invention. Because of the forming technique used the alternating portions may or may not be visible. However, preferably they are visible. This can be an attractive decorative effect for the can so produced. In any event, the alternating portions tend to have a strengthening effect and tend to increase the buckle strength of the can. This in turn may permit slight reductions in the gauge of the metal necessary to produce a can having adequate strength and pressure resistance and may reduce the overall weight of metal necessary to make a commercially acceptable beverage can.

Figure 8:
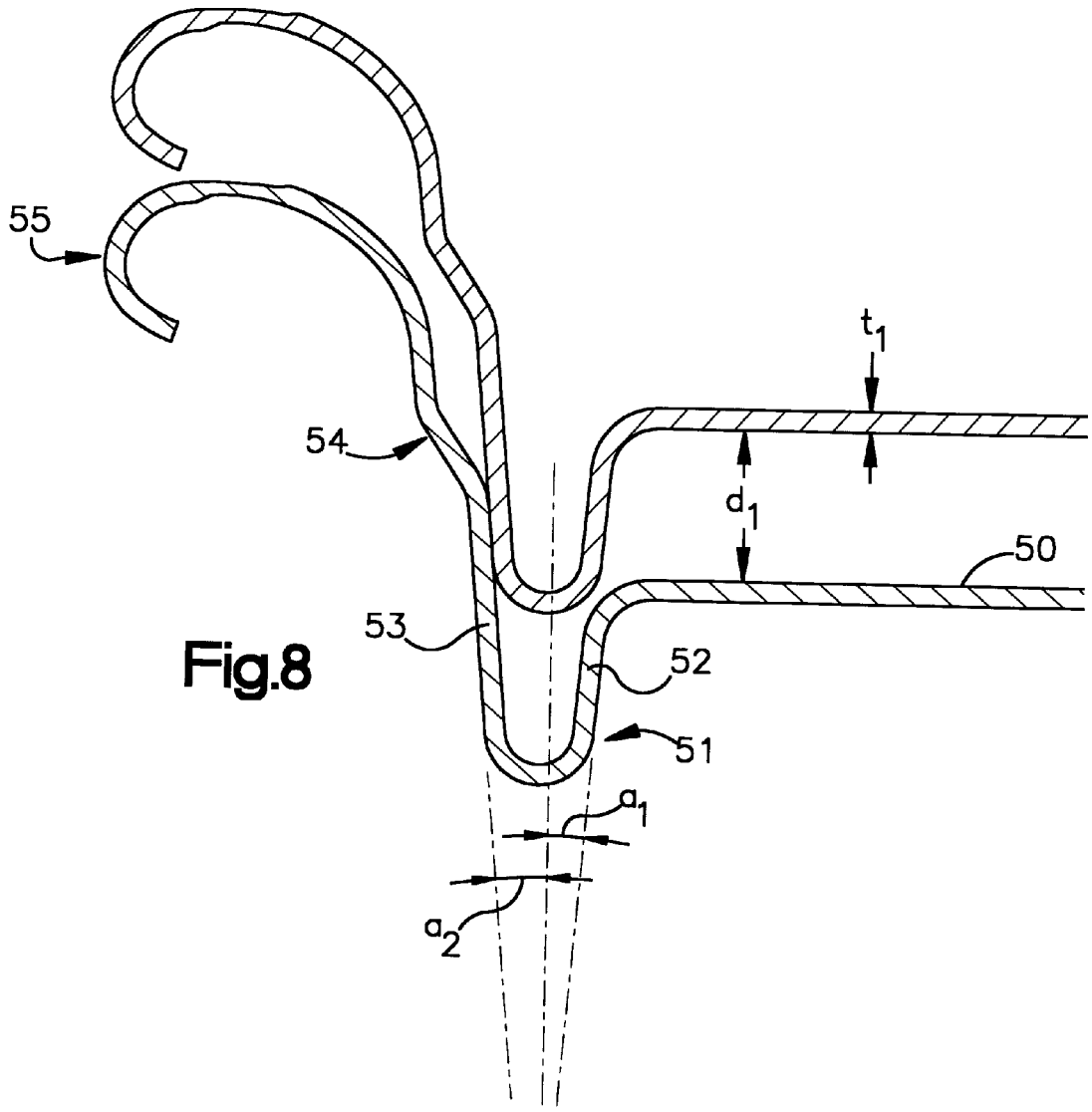
FIG. 8 is a cross section of a portion of two stacked can ends adapted for stacking in a stable stack.

In a still further embodiment of the present invention, the lightweight cans of the present invention can be assembled with a folded seam having a reduced height in high speed seaming equipment utilizing can ends that are stackable as illustrated in FIG. 8 in stable stacks during processing. To form a stable stack a can end must contact the adjacent can ends in the stack near the periphery of the can end and not at the tab or other centrally located point. The metal beverage can end according to this embodiment comprises:

- a generally horizontal substantially circular central portion 50 having a pull tab (not shown) attached to the outer surface thereof, the uppermost portion of said pull tab projecting a first distance above the upper surface of said central portion,
- a downwardly projecting rib 51 around the periphery of said central portion comprising an inner wall 52 and an outer wall 53 connected at the bottom to form said rib, said inner wall 52 projecting downwardly and away from said central portion at a first predetermined angle $a_1$, said outer wall projecting upward from the bottom of the rib and away from said center portion at a second predetermined angle from vertical $a_2$, and
- a seaming portion 55 attached to the upper end of said outer wall which cooperates with said can body to form a reduced seam having a height of about 0.050" to about 0.085", wherein the sine of angle $a_1$ or $a_2$ times said first distance $d_1$ equals or is less than the thickness $t_1$ of said can end.

Stackable can ends produced in accordance with the above described relationships contact the adjacent can ends, when stacked, along either inner wall 52 or outer wall 53 depending on the relative relationship of angles $a_1$ and $a_2$.

Optionally, the can end of this embodiment of the present invention may have a step 54 in the outer leg thereof. The step acts to limit the area of contact between adjacent can ends in the stack. Excessive contact can cause the can ends in the sack to stick together and interfere with the smooth operation of the associated high-speed equipment.

Figure 5A:
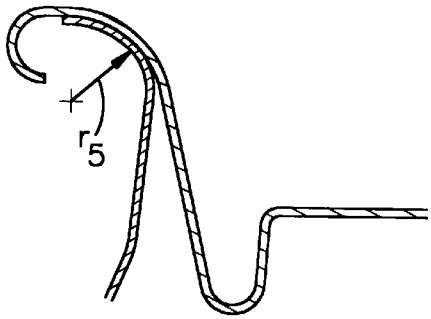
FIG. 5A is a cross section of the portion of a conventional can body and can end prior to seaming.
Figure 5B:
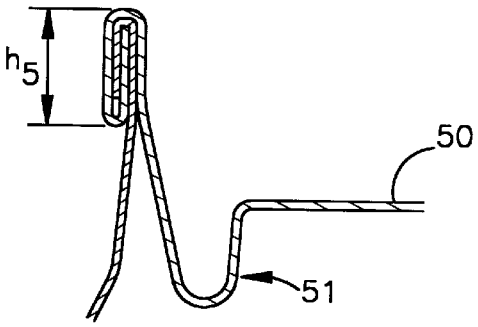
FIG. 5B is a cross section of a conventional can seam formed from the components illustrated in FIG. 5A.
Figure 6A:
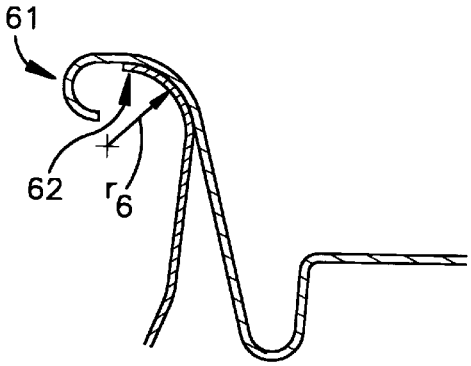
FIG. 6A is a cross section of a portion of a can body and can end adapted to be seamed with a reduced seam according to an embodiment of the present invention.
Figure 6B:
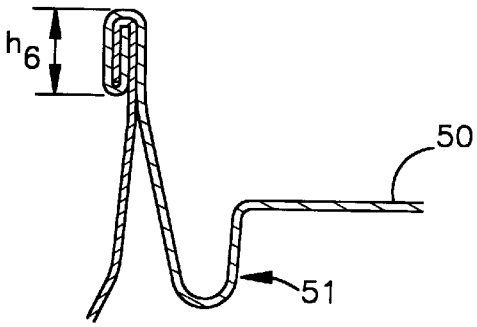
FIG. 6B is a cross section of a reduced seam formed from the components illustrated in FIG. 6A.
Figure 7A:
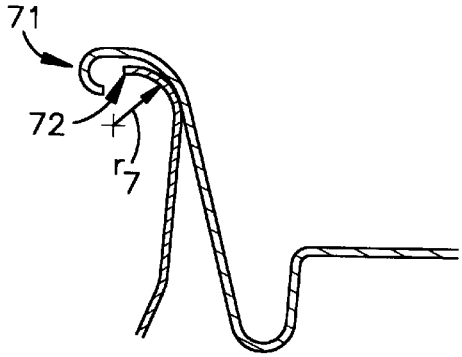
FIG. 7A is a cross section of a portion of a can body and a can end adapted to be seamed with a microseam according to an embodiment of the present invention.
Figure 7B:
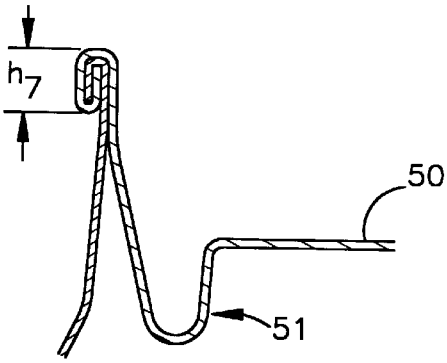
FIG. 7B is a cross section of a microseam formed from the components illustrated in FIG. 7A.

A seam of reduced height requires less metal than a taller conventional seam. FIG. 5A shows a cross sectional view of a portion of a conventional can body and a conventional can end formed and assembled in preparation for seaming. FIG. 5B shows a conventional seam formed from the components illustrated in FIG. 5A. The height $h_5$ of this seam is between about 0.090 inches and about 0.110 inches. FIG. 6A shows a cross sectional view of a portion of a can body and a can end adapted to be assembled by a seam having a reduced height. The end curl 61 and the body curl 62 are shorter than the corresponding portions of the conventional design shown in FIG. 5A. FIG. 6B shows a seam of reduced height formed from the components shown in FIG. 6A. FIG. 7A shows a cross sectional view of a portion of a can body and a can end adapted to be assembled by a microseam. The end curl 71 and the body curl 72 are further reduced compared to the conventional design as shown in FIGS. 5A and 5B and the reduced height seam design shown in FIGS. 6A and 6B. FIG. 7B shows a microseam formed from the components illustrated in FIG. 7A.

Strict control over the dimensions of the can body and the can end is required to insure that hermetically sealed seams are reproducibly formed. Failure rates of even 1 in a 100,000 or 1,000,000 are considered unacceptable in the can making industry. In fact it is common to "tune" the dimensions and other variables to the specific can line. Accordingly, the optimum dimensions and metal properties for one line may not be optimum for another. For example in FIG. 6A the radius $r_6$ may have to be varied from 0.045" to 0.050" to reliably produce lightweight cans according to the present invention on a given can making line. In a similar fashion other dimensions may have to be adjusted.

Either the reduced seam or the microseam of the present invention will reduce the amount of metal required to make a can. The reduced height seam shown in FIG. 6B has a height $h_6$ of about 0.078". Typically a reduced height seam according to the present invention will have a height of about 0.070" to about 0.085" and preferably have a height of about 0.075" to about 0.080". The microseam shown in FIG. 7B has a height $h_7$ of about 0.057". Typically a microseam in accordance with the present invention will have a height of about 0.050" to about 0.069" and preferably have a height of about 0.055" to about 0.065".

Further steps may be necessary or desirable in forming the can body. For example, providing a specific buckle resistant shape to the bottom wall of the body such as a central concave depression, or providing a specific inward necking profile of the upper end of the can body. Many designs and techniques for providing these features are known in the art and may be adapted to the can bodies of the present invention.

The can body formed as described above is mated with and seamed to a can end. In accordance with the present invention the can end may be of conventional design or it may incorporate one or more features of the present invention. Similarly, the can body may be of conventional design or it may incorporate one or more features of the present invention, provided that if the can body is of conventional design the can end incorporates at least one feature of the present invention and if the can end is of conventional design the can body incorporates at least one of the features of the present invention. One or any combination of two or more of the features of the present invention may be used in the same lightweight can pursuant to the present invention.

Having described the invention with respect to certain specific embodiments thereof it will be apparent that certain modifications can be made without departing from the spirit and scope of the present invention.

We claim:

1. A lightweight metal beverage can comprising a can end seamed around the periphery to a can body said can body having a domed bottom adapted to stack on top of a similar can and an ironed side wall wherein said side wall has alternating sections of relatively thicker and relatively thinner metal thickness around the diameter of said side wall each such section being oriented in the direction the ironing mandrel moves during ironing of said side wall.

2. A lightweight metal beverage can in accordance with claim 1 wherein the dome of said bottom is larger in diameter than the outside diameter of the seam between said can end and said can body such that when stacked the top of one can fits inside the dome of the adjacent can.

3. A lightweight metal beverage can in accordance with claim 1 wherein the can body thereof is formed from a cup having a variable radius between the side wall and the bottom thereof.

4. A lightweight metal beverage can in accordance with claim 3 wherein the radius between the bottom of said cup and the wall of said cup is larger in locations that correspond to the direction of the grain of the metal in said cup and smaller in locations that are across said grain.

5. A lightweight metal beverage can in accordance with claim 1 wherein the seam between said can body and said can end has a height of between 0.085" and 0.050".

6. A lightweight metal beverage can in accordance with claim 5 wherein said can end has a downwardly protruding rib around the periphery thereof adjacent said seam.

7. A lightweight metal beverage can comprising a can body having substantially reduced ears prior to trimming the top edge thereof, said can body being formed from a cup having a variable radius between the side wall and the bottom thereof and said cup being formed from an acircular blank, the perimeter of which comprises a series of connected arc segments, said arc segments having a larger radius in portions of the blank where ears tend to form and a smaller radius in portions of the blank where ears do not tend to form, wherein said side wall is ironed and has alternating sections of relatively thicker and relatively thinner metal thickness around the diameter thereof each such section being oriented in the direction the ironing mandrel moves during ironing of said side wall.

8. A lightweight metal beverage can comprising a can end formed from sheet metal seamed around its periphery to a can body said can body having an ironed side wall and a domed bottom adapted to stack in an interfitting relationship on top of a similar can, said can end having a) a generally horizontal substantially circular central portion having a pull tab attached to the outer surface thereof, the uppermost portion of said pull tab projecting a first distance above the upper surface of said central portion;

b) a downwardly projecting rib around the periphery of said central portion comprising an inner wall and an outer wall connected at the bottom to form said rib, said inner wall projecting downwardly and away from said central portion at a first predetermined angle from vertical, said outer wall projecting upwardly from the bottom of the rib and away from said center portion at a second predetermined angle from vertical; and c) a seaming portion attached to the upper end of said outer wall which cooperates with said can body to form a seam having a height of about 0.050" to about 0.085", wherein the sine of the angle from vertical of said inner wall or said outer wall times said first distance equals or is less than the thickness of said metal sheet in said can end.

9. The lightweight metal beverage can according to claim 8 wherein said can end has a step in said outer wall.

10. A lightweight metal beverage can according to claim 8 wherein said ironed side wall has alternating vertically disposed sections of relatively thicker and relatively thinner metal thickness.

11. A lightweight metal beverage can according to claim 8 wherein the can body thereof is formed from an acircular blank adapted to form a can body having substantially reduced ears prior to trimming the top edge thereof.

12. A lightweight metal beverage can according to claim 11 wherein said acircular blank has a larger radius in portions of the blank where ears tend to form and a smaller radius in portions of the blank where ears do not tend to form.

13. A lightweight metal beverage can according to claim 12 wherein the radius of the blank in the direction of the grain of the metal in said blank is larger than the radius of the blank in the direction across the grain.

14. A lightweight metal beverage can according to claim 13 wherein the radius of the blank in a direction at an angle of 45° to the direction of the grain of the metal in said blank is larger than the radius of the blank in the direction of said grain.

15. A lightweight metal beverage can according to claim 8 wherein the can body thereof is formed from a cup having a variable radius between the side wall and the bottom thereof.

* * * * *